US007922049B2

(12) United States Patent
Wu et al.

(10) Patent No.: US 7,922,049 B2
(45) Date of Patent: Apr. 12, 2011

(54) STRAP FOR PORTABLE DEVICES

(75) Inventors: Yi-Chun Wu, Taipei Hsien (TW); Chung-Sen Huang, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 746 days.

(21) Appl. No.: 12/016,141

(22) Filed: Jan. 17, 2008

(65) Prior Publication Data

US 2009/0114687 A1 May 7, 2009

(30) Foreign Application Priority Data

Nov. 5, 2007 (CN) ..... 2007 1 0202394

(51) Int. Cl.
*A45F 3/14* (2006.01)
*A45F 5/00* (2006.01)

(52) U.S. Cl. ..... 224/220; 224/258; 224/267; 224/254; 224/930

(58) Field of Classification Search ..... 224/219, 224/220, 254, 257, 258, 930, 267; 24/3.13; 119/798

See application file for complete search history.

(56) References Cited

U.S. PATENT DOCUMENTS

| | | | | |
|---|---|---|---|---|
| 2,248,338 | A * | 7/1941 | Castleman | 24/3.6 |
| 2,522,719 | A * | 9/1950 | Johnson | 224/220 |
| 3,124,286 | A * | 3/1964 | Dompier | 224/255 |
| 4,488,511 | A * | 12/1984 | Grassano | 119/798 |
| 4,870,843 | A * | 10/1989 | Lundberg | 70/233 |
| 5,816,458 | A * | 10/1998 | Yonenoi | 224/182 |
| 7,357,284 | B2 * | 4/2008 | Jauvin | 224/660 |
| 7,530,334 | B1 * | 5/2009 | Napolitano | 119/798 |
| 2007/0278265 | A1 * | 12/2007 | Contente | 224/162 |

* cited by examiner

*Primary Examiner* — Justin M Larson
(74) *Attorney, Agent, or Firm* — Jeffrey T. Knapp

(57) ABSTRACT

An exemplary strap for a portable device includes a hollow ring portion, two elastic members, two connecting strings, two blocks, and a strap attachment coupled to the connecting strings. The ring portion includes at least one restraint with a through hole defined therein. The elastic members are fixed within the ring portion. The connecting strings are coupled to the elastic members respectively, pass through the through hole and stretch out of the ring portion. The blocks are positioned respectively at joints of the elastic members and the connecting strings, and restrained within the ring portion by the at least one restraint for preventing the elastic members from being excessively stretched.

12 Claims, 2 Drawing Sheets

STRAP FOR PORTABLE DEVICES

BACKGROUND

1. Technical Field

The present invention relates to portable devices and, particularly, to an adjustable, compact, and wearable strap for portable devices.

2. Description of Related Art

Generally, a portable device has a strap that facilitates convenient carry of the portable device. A conventional strap comprises a wrist or neck ring portion, a take-up reel secured to the ring portion via a ring, a string rolled in the take-up reel, and a strap attachment for connecting the strap to the portable device. It is inconvenient, unsightly, and a waste of space in that several of the components are exterior to the strap.

What is needed, therefore, is a compact wearable strap for holding portable devices.

SUMMARY

Accordingly, a strap for a portable device includes a hollow ring portion, two elastic members, two connecting strings, two blocks, and a strap attachment coupled to the connecting strings. The ring portion includes at least one restraint with a through hole defined therein. The elastic members are fixed within the ring portion. The connecting strings are coupled to the elastic members respectively, pass through the through hole and stretch out of the ring portion. The blocks are positioned respectively at joints of the elastic members and the connecting strings, and restrained within the ring portion by the at least one restraint for preventing the elastic members from being excessively stretched.

Other advantages and novel features will be drawn from the following detailed description of at least one preferred embodiment, when considered in conjunction with the attached drawings.

BRIEF DESCRIPTION OF THE DRAWINGS

Many aspects of the present strap can be better understood with reference to the following drawings. The components in the drawings are not necessarily drawn to scale, the emphasis instead being placed upon clearly illustrating the principles of the present strap. Moreover, in the drawings, like reference numerals designate corresponding parts throughout the several views.

DETAILED DESCRIPTION OF THE EMBODIMENTS

Embodiments of the present strap will now be described in detail below and with reference to the drawings.

Figure 1:
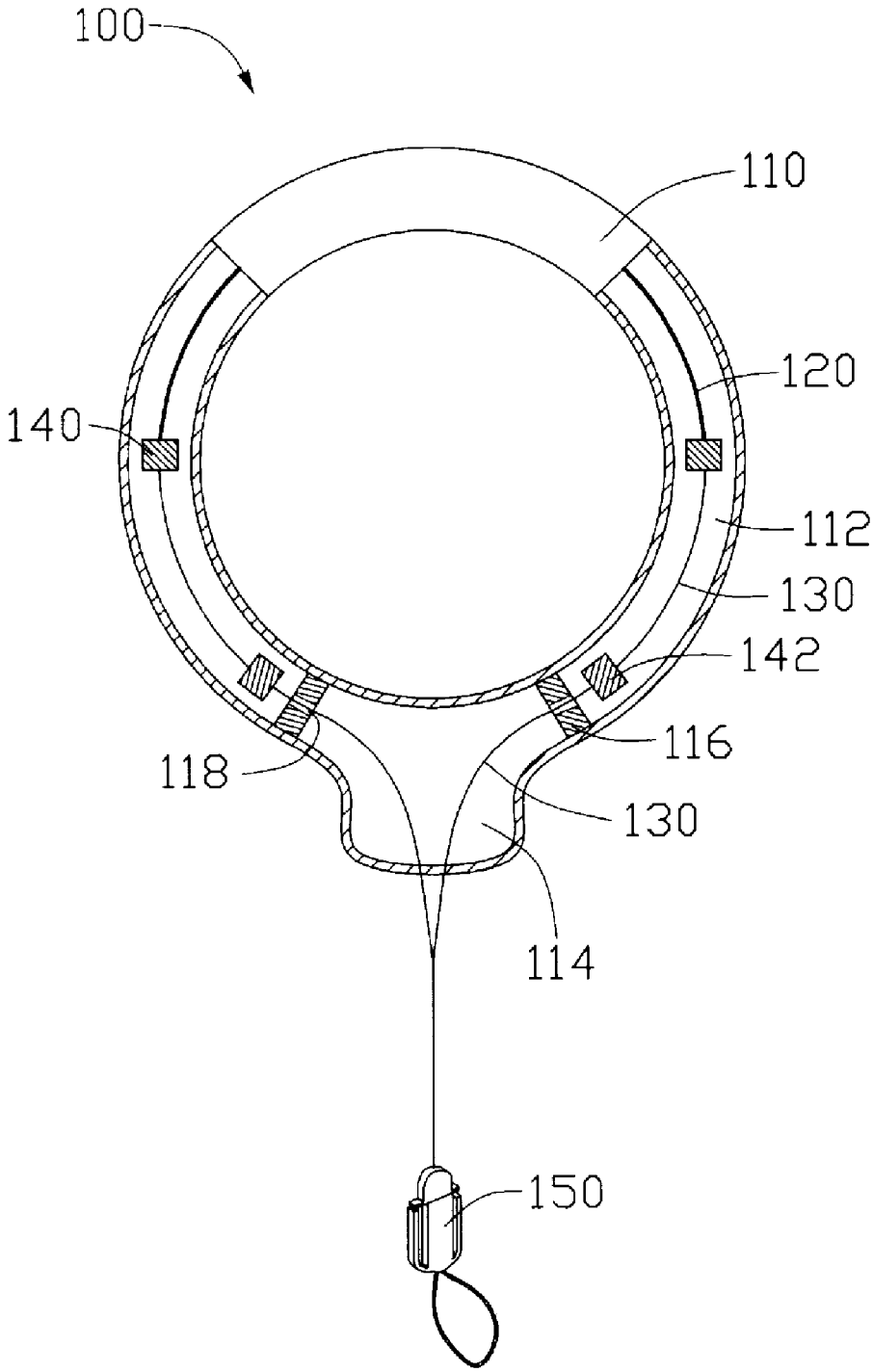
FIG. 1 is a schematic, isometric partially cut away view of a wearable strap for portable devices in accordance with a present embodiment.
Figure 2:
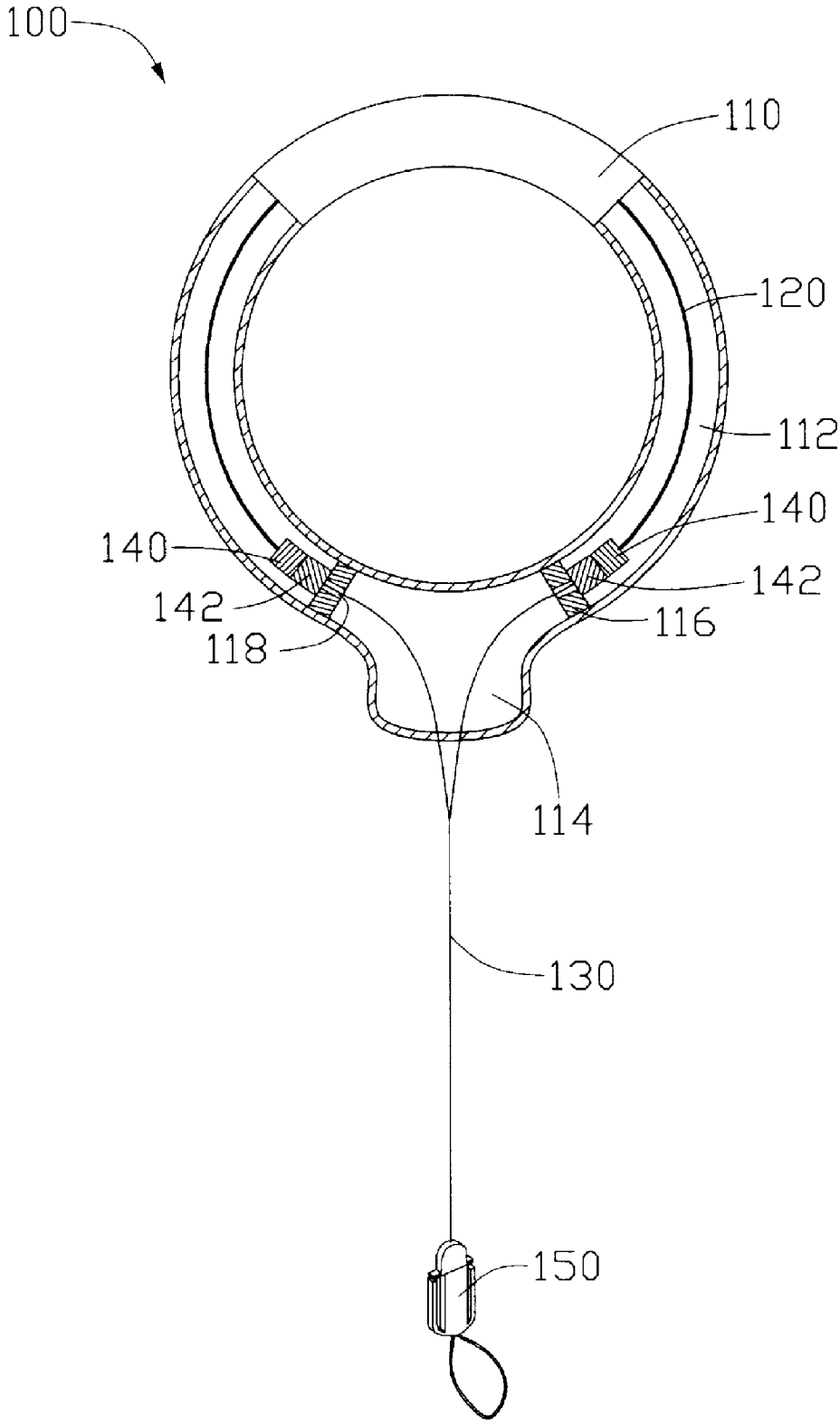
FIG. 2 is similar to FIG. 1, but the wearable strap is in use.

Referring to FIGS. 1-2, a wearable strap 100 in accordance with a present embodiment is illustrated. The strap 100 is used to hold a portable device (not shown), such as a digital still camera (DSC), a mobile phone, or the like. The strap 100 comprises a wrist or neck ring portion 110, two elastic members 120, two connecting strings 130, two blocks 140, and a strap attachment 150 coupled to the connecting strings 130 for connecting the strap 100 to the portable device (not shown). The ring portion 110 is hollow and is designed to be worn around a neck or wrist. The ring portion 110 receives the elastic members 120, the connecting strings 130, and the blocks 140 therein, but with part of the connecting strings 130 exposed to exterior thereof.

The ring portion 110 is elastic for an adjustable length, and defines a first chamber 112 and a second chamber 114. Two restraints 116 are arranged in the ring portion 110 to partition the first chamber from second chamber 112, 114. A through hole 118 is defined in each restraint 116 to communicate the second chamber 114 with the first chamber 112.

The elastic members 120 can be spiral springs, or be made of rubber or other elastic materials. One end of each elastic member 120 is fixed to the ring portion 110, and an opposite end of each elastic member 120 is coupled to one connecting string 130. Each connecting string 130 stretches from the corresponding elastic member 120, and passes through the corresponding through hole 118 and the second chamber 114, then to the exterior of the ring portion 110.

Each block 140 is positioned at a joint of one elastic member 120 and the corresponding connecting string 130, and is larger than the through hole 118. The blocks 140 are made of soft material, such as sponge, rubber or the like, and are restrained within the first chamber 112 by the restraints 116 for preventing the elastic members 120 from being excessively stretched. Between each block 140 and the corresponding restraint 116, an optional block 142 is slidably positioned on the connecting string 130, for enhancing reliability of the strap 100. In other words, the blocks 140 are disposed at the joints of the elastic members 120 and the connecting strings 130, the blocks 142 are disposed between the joints of the elastic members 120 and the connecting strings 130 and the restraints 116.

In the strap 100, lengths of the elastic members 120 are adjustable and the connecting strings 130 can be drawn out according to practical requirements, by exerting a force on the strap attachment 150. FIG. 2 shows each elastic member 120 is stretched to have the largest length. At this time, the blocks 142 are restrained by the restraints 116, and the blocks 140 reach the blocks 142, respectively. After the force exerted on the strap attachment 150 is released, the elastic members 120 are drawn back due to elasticity of the elastic members 120. Furthermore, the ring portion 110 is also elastic for promoting adjustability of the strap 100. It is understood that only one restraint 116 is required in other embodiments, so long as the restraint 116 can restrain the blocks 140, 142 in the ring portion 110.

In the embodiment, only the connecting strings 130 can extend out of the ring portion 110 to couple with the strap attachment 150 which can be secured to the portable device (not shown). The elastic members 120, the blocks 140, 142 and the restraints 116 are disposed within the chambers 112, 114. Therefore, the strap 100 is compact and sightly.

It will be understood that the above particular embodiments and methods are shown and described by way of illustration only. The principles and features of the present invention may be employed in various and numerous embodiments thereof without departing from the scope of the invention as claimed. The above-described embodiments illustrate the scope of the invention but do not restrict the scope of the invention.

What is claimed is:

1. A strap for a portable device, comprising:

a hollow ring portion comprising at least one restraint therein, the at least one restraint defining a through hole therein, wherein the ring portion defines a first chamber and a second chamber partitioned from the first chamber by the at least one restraint;

two elastic members fixed within the ring portion;

two connecting strings coupled to the elastic members respectively, passing through the through hole and stretching out of the ring portion;

two blocks positioned respectively at joints of the elastic members and the connecting strings, and restrained within the ring portion by the at least one restraint for preventing the elastic members from being excessively stretched; and a strap attachment coupled to the connecting strings; wherein the elastic members and the blocks are received in the first chamber and the connecting strings stretch out of the ring portion via the second chamber.

2. The strap as claimed in claim 1, wherein the ring portion is elastic for an adjustable length.

3. The strap as claimed in claim 1, wherein the elastic members are made of rubber.

4. The strap as claimed in claim 1, wherein the blocks are made of sponge.

5. The strap as claimed in claim 1, wherein the blocks are made of rubber.

6. The strap as claimed in claim 1, wherein two additional blocks are slidably positioned on the connecting strings between the joints and the at least one restraint.

7. The strap as claimed in claim 6, wherein the additional blocks are made of rubber.

8. The strap as claimed in claim 6, wherein the additional blocks are made of sponge.

9. A strap for a portable device, comprising: a hollow ring portion comprising at least one restraint therein, the at least one restraint defining a through hole therein; two elastic members fixed within the ring portion; two connecting strings coupled to the elastic members respectively, passing through the through hole and stretching out of the ring portion; two blocks positioned respectively at joints of the elastic members and the connecting strings, and restrained within the ring portion by the at least one restraint for preventing the elastic members from being excessively stretched; two additional blocks slidably positioned on the connecting strings between the joints and the at least one restraint; and a strap attachment coupled to the connecting strings.

10. The strap as claimed in claim 9, wherein the additional blocks are made of sponge.

11. The strap as claimed in claim 9, wherein the additional blocks are made of rubber.

12. A strap for a portable device, comprising:

a ring-shaped housing comprising an opening and two restraints at opposite sides of the opening, each of the restraints defining a through hole therein;

two elongated elastic members each having a first end fixed in the housing and an opposite second end;

two connecting strings each having a first end coupled to the second end of respective elastic members, and a second end extending through the through hole of the restraints and extending out of the ring-shaped housing via the opening for attachment to a portable device;

two first blocks fixedly coupled to the respective connecting strings, adjacent to joints between the connecting strings and the elastic members, and received within the housing, the size of the first blocks greater than that of the through holes of the respective restraints; and two second blocks disposed between the first blocks and the restraints, with the size thereof greater than the size of the through holes of the respective restraints; the connecting strings extending through the second blocks, the second blocks being movable relative to the respective connecting strings.

* * * * *